US007243935B2

(12) United States Patent
Beumer

(10) Patent No.: US 7,243,935 B2
(45) Date of Patent: Jul. 17, 2007

(54) WHEELCHAIR HAVING A PIVOT PROVISION ADJACENT THE KNEE OF A USER

(75) Inventor: Stefanus Theodorus A. G. Beumer, Gendringen (NL)

(73) Assignee: Ludgerus Beheer B.V., Gendringen (NL)

( * ) Notice: Subject to any disclaimer, the term of this patent is extended or adjusted under 35 U.S.C. 154(b) by 0 days.

(21) Appl. No.: 10/171,800

(22) Filed: Jun. 14, 2002

(65) Prior Publication Data

US 2003/0230868 A1 Dec. 18, 2003

(51) Int. Cl.
*A61G 5/00* (2006.01)

(52) U.S. Cl. ..... 280/250.1; 297/DIG. 4; 297/313; 280/304.1

(58) Field of Classification Search ..... 280/250.1, 280/304.1, 6.15; 297/DIG. 4, 313
See application file for complete search history.

(56) References Cited

U.S. PATENT DOCUMENTS

| | | | | | |
|---|---|---|---|---|---|
| 521,463 | A | * | 6/1894 | Smith-Fraser | 297/372 |
| 3,415,531 | A | * | 12/1968 | Kiel | 280/30 |
| 4,078,817 | A | * | 3/1978 | Ferguson et al. | 280/250.1 |
| 4,125,269 | A | * | 11/1978 | Kiel | 280/30 |
| 4,200,332 | A | * | 4/1980 | Brauning | 297/300.3 |
| 4,383,714 | A | * | 5/1983 | Ishida | 297/325 |
| 4,544,200 | A | * | 10/1985 | Dunn et al. | 297/265.1 |
| 4,572,533 | A | * | 2/1986 | Ellis et al. | 280/250.1 |
| 4,597,567 | A | * | 7/1986 | Racca | 267/140.2 |
| 4,641,848 | A | * | 2/1987 | Ayers | 280/242 |
| 4,707,026 | A | * | 11/1987 | Johansson | 297/281 |
| 4,712,835 | A | * | 12/1987 | Volkle | 297/300.5 |
| 4,889,384 | A | * | 12/1989 | Sulzer | 297/303.4 |
| 4,889,385 | A | * | 12/1989 | Chadwick et al. | 297/300.1 |
| 5,004,259 | A | * | 4/1991 | Ayers et al. | 280/304.1 |
| 5,154,438 | A | * | 10/1992 | Barclay | 280/250.1 |
| 5,181,762 | A | | 1/1993 | Beumer | 297/358 |
| 5,348,372 | A | * | 9/1994 | Takamatsu et al. | 297/303.1 |
| 5,727,802 | A | * | 3/1998 | Garven et al. | 280/250.1 |
| 5,904,398 | A | * | 5/1999 | Farricielli | 297/313 |
| 5,997,021 | A | * | 12/1999 | Robinson et al. | 280/250.1 |
| 6,276,704 | B1 | * | 8/2001 | Suiter | 280/250.1 |
| 6,382,724 | B1 | * | 5/2002 | Piretti | 297/302.3 |
| 6,394,476 | B1 | * | 5/2002 | Molnar | 280/250.1 |
| 6,419,253 | B1 | * | 7/2002 | Mascari | 280/250.1 |
| 6,595,584 | B1 | * | 7/2003 | Caldwell | 297/258.1 |
| 2002/0043844 | A1 | * | 4/2002 | Hobb et al. | 297/302.3 |
| 2005/0073129 | A1 | * | 4/2005 | Meyers et al. | 280/304.1 |
| 2005/0116440 | A1 | * | 6/2005 | Bernatsky et al. | 280/250.1 |

FOREIGN PATENT DOCUMENTS

EP 1 295 582 A3 1/2004

* cited by examiner

*Primary Examiner*—Lesley D. Morris
*Assistant Examiner*—Daniel Yeagley
(74) *Attorney, Agent, or Firm*—Michael & Associates; Peter L. Michaelson

(57) ABSTRACT

Wheelchair of which a sitting support is pivotable about a virtual or non-virtual pivot axis, extending substantially horizontally, substantially at right angles to a main driving direction of the wheelchair, wherein the upper part of the body of the user, at least its center of gravity, viewed in the main driving direction, lies behind the pivot axis and wherein the pivot axis is located preferably adjacent the hinge point of the knees of a user seated in the wheelchair during use. The sitting support may be freely pivotable about said pivot axis or be fixed at a particular pivot angle. The pivot axis can for instance be designed as a torsion bar.

24 Claims, 6 Drawing Sheets

WHEELCHAIR HAVING A PIVOT PROVISION ADJACENT THE KNEE OF A USER

The invention relates to a wheelchair, in particular a wheelchair of which a sitting support, during use, is pivotable about a pivot axis extending substantially horizontally, substantially at right angles to a main driving direction.

Wheelchairs whose sitting support is pivotable or tiltable about the axis mentioned are known from practice. Such tilting provisions offer the possibility to adjust the position of the sitting support to a sitting posture desired for a particular activity such as reading, writing or resting. Thus, the body of the wheelchair user can always be optimally supported, so that the pressure exerted by the sitting support is uniformly distributed over the body. Moreover, the sitting posture can thus be regularly varied, which is beneficial to the blood circulation and, with long-term wheelchair use, helps prevent decubitus.

From practice, a type of wheelchair is known whose sitting support is tiltable about a transverse axis, which is located under a seat supporting part of the sitting support, viewed in driving direction, adjacent a posterior edge thereof. A drawback of this known wheelchair is that the number of sitting angles which can be set is limited to a number of discrete positions, so that an optimal seating for each desired sitting posture is not feasible. Furthermore, upon a backward tilting of the sitting support, the center of gravity of a user seated in the wheelchair shifts relatively far backwards, in the direction of the axis of the rear wheels or even beyond that. As a result, the wheelchair obtains an unstable road-holding and, due to a slight unevenness in the surface or an unexpected movement of the user, it can tilt backwards. In view of this risk, the tilting provision is unsuitable for use during active wheelchair use.

Further, a type of wheelchair is known wherein the seat support during tilting translates simultaneously in horizontal direction, such that the center of gravity of the wheelchair user retains approximately the same position and, therefore, the wheelchair remains in balance. This tilting mechanism too can only be set to a limited number of positions and is intended for use with a stationary wheelchair. Moreover, the tilting mechanism is constructionally complicated and heavy and therefore susceptible to malfunction and expensive.

The invention contemplates a wheelchair, wherein the drawbacks mentioned are obviated while maintaining its advantages. To that end, a wheelchair according to the invention is characterized by the features of an embodiment of the present invention.

As at least the seat of the sitting support is pivotable, the position of the sitting support, at least the seat, can continuously adjust itself or be adjusted to the sitting posture of the wheelchair user. The pivot axis, placed relatively far forward, provides that the wheelchair remains in balance during pivoting of the seat. The fact is that, as the pivot axis, viewed from the driving direction, lies in front of the center of gravity of a user seated in the wheelchair, the seat will experience a backward tilting moment under the influence of the weight of the user. As a result, a stable, backwardly tilted sitting posture is obtained with a relatively low center of gravity, favorable to the road-holding of the wheelchair. Furthermore, this center of gravity, generally located far backwards during use, adjacent the rear wheels, will, during backwards tilting of the seat, move slightly forward, which contributes to a still more stable road-holding. Therefore, both during standstill and active wheelchair use, the wheelchair user can be supported well and stably, so that a wheelchair is obtained with an optimal sitting and driving comfort.

In a further elaboration, a wheelchair according to the invention is characterized by the features of alternate embodiments of the present invention.

By arranging the coupling means such that the pivot axis approximately coincides with the knees of the wheelchair user, at least the hinge point thereof, the advantage is obtained that the upper part of the body and the upper legs of this user can be tilted virtually without changing the position of his lower legs. Because of this, during tilting of the upper part of his body, the wheelchair user can keep his feet on the ground or on foot rests provided to that end. This gives him a feeling of greater stability and facilitates getting up from the chair after a forward tilting movement.

Further, the position of the knees during pivoting between different positions will virtually not change, which is favorable in particular when the wheelchair user is at a location with a limited freedom of movement for the knees, for instance underneath a table top. The pivot axis, for that matter, need not coincide with a physical axis. A virtual pivot axis offers the advantage that, through a correct design of the coupling means, it can be placed exactly at the height of the hinge point of the knee or a different desired position, without the user being physically hindered thereby. The coupling means themselves can be arranged at a location where they will not be in the way of the user, for instance under the sitting support.

In an advantageous embodiment, a wheelchair according to the invention is characterized by the features of the advantageous alternate embodiment of the present invention.

By providing the coupling means with at least one resilient element, the driving comfort can be still further enhanced. The sitting support, supported by the at least one resilient element, forms, together with the user, a mass spring system which transforms external shocks and vibrations resulting from irregularities in the road surface, into a damped pivotal movement, comfortable to the user. Preferably, the spring rigidity is adjustable so that the frequency and the stroke of the pivotal movement can be geared to the characteristics and desires of the user, such as his body weight, way of driving and personal preference regarding springing and damping.

In an advantageous embodiment a wheelchair according to the invention is further characterized by the features of another alternate embodiment of the present invention.

By biasing the at least one resilient element, a sitting support can he obtained of which at least the seat in unloaded condition inclines forward somewhat. Thus, a so-called step-in-active and step-out-active sitting angle is obtained. Such a sitting angle simplifies sitting down in and getting up from the wheelchair. The fact is that, when stepping in, the user needs to bend his knees less before reaching the seat and, when getting up, needs to rise from a less deep position. Additionally, when getting up and sitting down, this support can provide the user with a sense of security. Furthermore, the center of gravity of the user is already in a somewhat higher position in the forward-tilted position of the seat, so that less strength is needed to get up.

In a further elaboration of a preferred embodiment, a wheelchair according to the invention is characterized by the features of claims yet another alternate embodiment of the present invention.

By using a torsion bar as pivot axis, a constructionally very simple tilting mechanism can be realized which, furthermore, takes up little space and therefore can be arranged adjacent the hinge point of the knee of the user, without hindering him physically.

In a further advantageous embodiment, a wheelchair according to the invention is characterized by the features of an embodiment described herein below.

Preferably, the wheelchair sitting support is equipped with a feet-supporting element. This element can be attached both to the sitting support, in particular the seat, and to the substructure. In the first case, the lower legs can pivot along with the seat, so that the angle between lower and upper legs does not change and the knee joints are completely relieved. In the second case, a user can keep his lower legs in a fixed position during pivoting, so that, as already indicated hereinabove, during tilting, he maintains a feeling of stability and can easily get up from the chair.

In the further subclaims, further advantageous embodiments of a wheelchair according to the invention are described.

In elucidation of the invention, an exemplary embodiment of a wheelchair according to the invention will be described with reference to the drawing. In the drawing.

In this description, identical or corresponding parts have identical or corresponding reference numerals.

Figure 1:
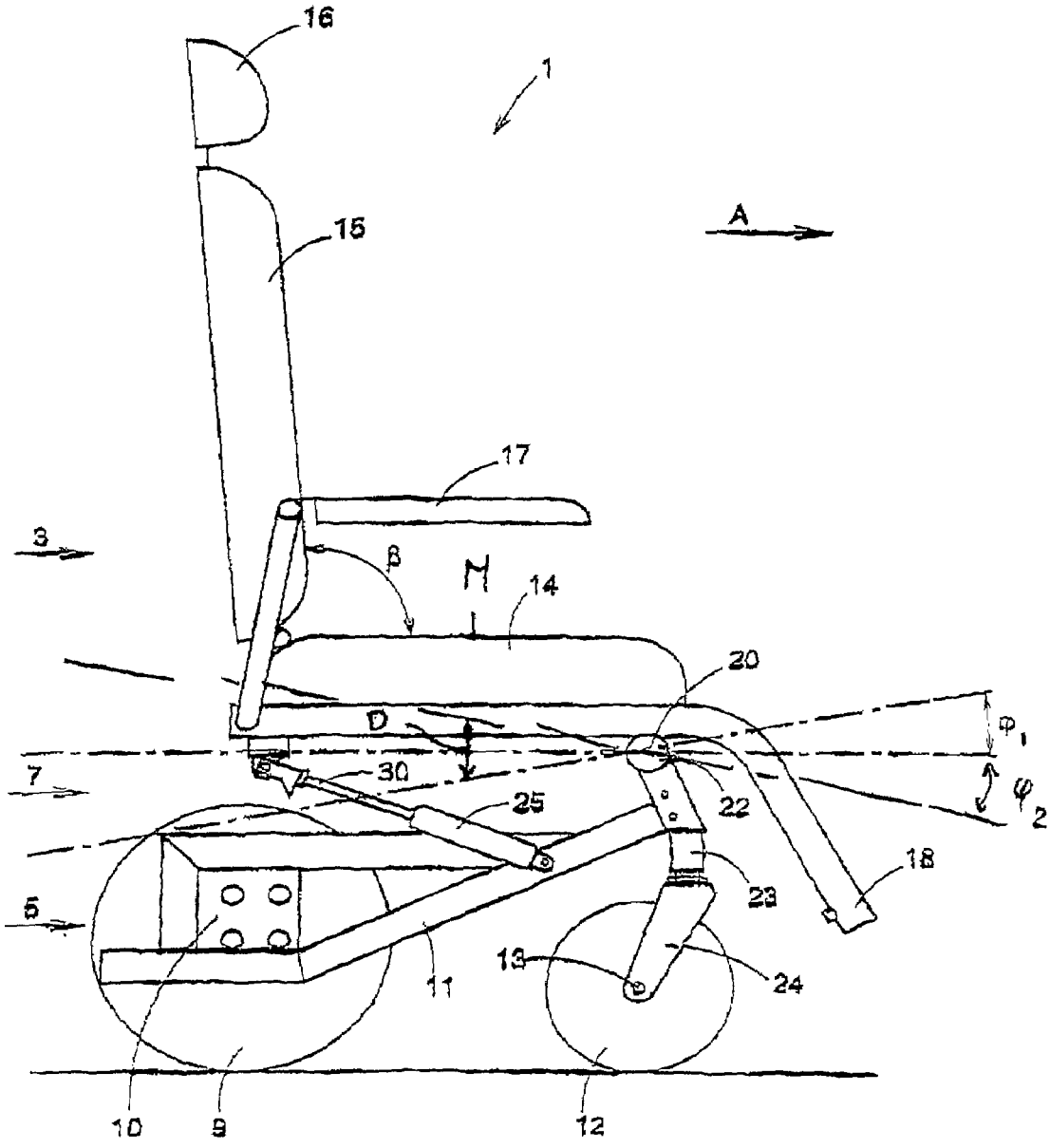
FIG. 1 shows a wheelchair according to the invention in side view.

FIG. 1 shows a wheelchair 1, comprising a sitting support 3, a substructure 5 and coupling means 7. The coupling means 7 connect the sitting support 3 to the substructure 5 such that at least a part of this sitting support is pivotable or tiltable about a horizontal axis, at right angles to a main driving direction of the wheelchair 1 indicated with arrow A. What is meant here by the main driving direction A, is the driving direction wherein the casters and the rear wheels roll in the same direction. What is meant here with tiltable or pivotable is in particular a rotation about a fixed physical or virtual axis. In FIG. 1, the tilting or pivotal angle is indicated with $\phi$. The tilting movement can be, as required, a free pivotal movement or an adjustable movement, in which last case the sitting support is tilted at a particular angle $\phi$ and, subsequently, is secured in this position. The operation and the advantages of both possibilities will be elucidated hereinbelow.

In the exemplary embodiment shown, the sitting support 3 comprises a seat 14 which supports the bottom and the upper legs of a wheelchair user, and a backrest 15. The seat 14 and the backrest 15 can mutually include a fixed sitting angle $\beta$, but are preferably pivotally connected to each other by means of a hinge known per se from practice, so that the sitting angle $\beta$ between the two parts can be adjusted. This sitting angle adjustment can be independent of the pivotal angle $\phi$, or, conversely, be partly coupled thereto, so that, for instance, upon a backward tilting of the seat 14, the sitting angle $\beta$ increases and upon a forward tilting, the sitting angle $\phi$ decreases, to, for instance, maximally 90 degrees.

Optionally, the sitting support 3 can additionally equipped with a head support 16, armrests 17 and footrests 18, as shown in FIG. 1. Preferably, the armrests 17 are pivotably or detachably connected to the sitting support 3, such that, when a patient is helped in or out of the wheelchair 1, they can be temporarily pivoted upwards or to the side or be removed. This will be elaborated later with reference to FIG. 5. Instead of forming part of the sitting support 3, the footrests 18 can also be attached to the substructure 5, the advantages of which will be elaborated later. Preferably, the sitting support 3 is self-supporting. This is understood to mean that the sitting support 3 is sufficiently rigid in itself to resist, during use, forces acting on this sitting support. Such a self-supporting sitting support can for instance be built up from a relatively rigid sitting tub manufactured from plastic, or a rigid frame of plastic or metal, in which sitting cushions are suspended or over which a flexible upholstery is stretched, as described in the non-prepublished Dutch patent application (equivalent to EP Patent Application No. EP 1295582 (A3) , published Mar. 26, 2003) of applicant entitled: "Self-supporting sitting support and wheelchair equipped therewith" which EP application is understood to be incorporated herein by reference.

The substructure 5 comprises a frame 11 from which two rear wheels 9 and two casters 12 are suspended to respective axles 10, 13. The substructure 5 shown in FIG. 1 comprises relatively small rear wheels and is, therefore, particularly intended to be pushed along by an attendant. Optionally, the wheelchair can be driven by a wheelchair user himself by means of, for instance, driving rods (not shown) engaging on the rear wheels 9. Then, the casters 12 help to stably support the wheelchair. The invention is not in any way limited to the type shown. For instance, as will appear hereinafter, the invention offers great advantages with wheelchairs destined for active use which are provided with relatively large rear wheels, of, for instance 20 or 21 inch, which are driven by the wheelchair user. The invention can also be used with, for instance, wheelchairs with three wheels, wheelchairs with front-wheel drive or electrically powered wheelchairs.

The coupling means 7 shown in FIG. 1 comprise a substantially resilient and a substantially damping element, in the form of a torsion bar 22 and a gas spring 25, respectively. Viewed from the driving direction A, the torsion bar 22 is arranged adjacent a front edge of the seat 14 and there, forms a physical pivot axis 20. Through its extremities, the gas spring 25 is pivotably connected between the substructure 5, in particular adjacent the front side of the wheelchair, and the seat 14, at some distance behind the torsion bar 22. Partly as a result thereof, a relatively long gas spring can be used, so that a large pivot angle $\phi$, for instance 20 to 40° is attainable.

Figure 2:
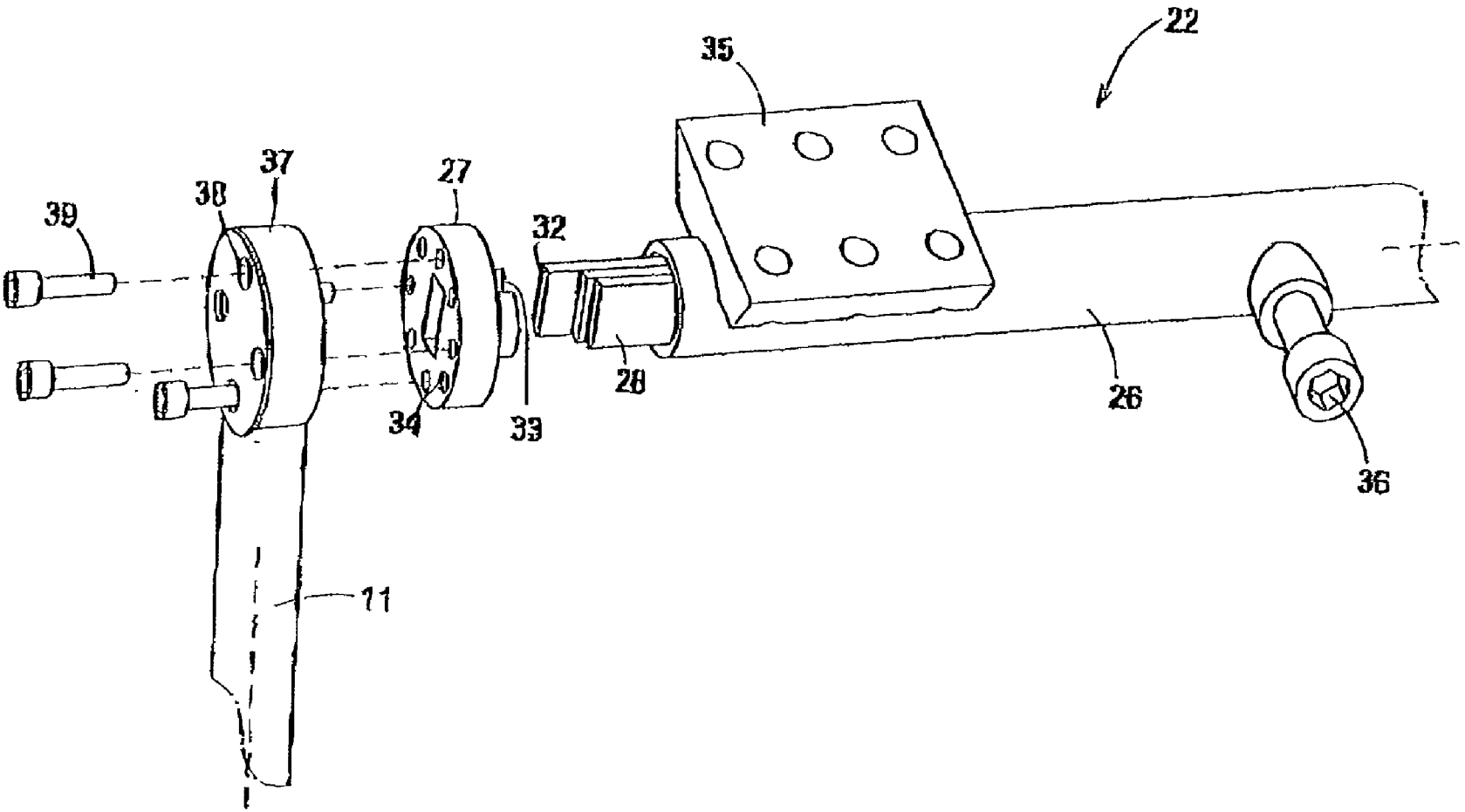
FIG. 2 shows an embodiment of a torsion bar according to the invention, as used in the wheelchair of FIG. 1.

FIG. 2 shows a part of a torsion bar 22 in cutaway perspective view. The torsion bar 22 comprises a tube 26, in which a packet of leaf springs 28 is accommodated. The tube 26 can be closed off on opposite sides with a cover 27. Each cover 27 is provided on the inwardly facing side with a slot-shaped receiving provision 33 in which the leaf springs 28 are confined with their extremities 32. With the aid of bolts 39, the covers 27 of the torsion bar 22 can be attached between two side frame parts 11 of a wheelchair 1 on clasps 37 provided to that end. Along their circumference, cover 27 and clasp 37 are both provided with fastening holes 34, 38, whose relative position is such that the covers 27 can be attached to the side frame parts 11 at different angles, the purpose of which will be elaborated hereinbelow. Further, the torsion bar 22 can be attached with at least one fastening plate 35 and one fastening bolt 26 to a seat 14 and a frame part 11 located below the seat 14 of the wheelchair 1, respectively.

The thus obtained torsion bar 22 is simple in construction, robust and, therefore, little susceptible to malfunction. Furthermore, the rigidity of the torsion bar can be simply adjusted to characteristics and individual wishes of a wheelchair user, by varying the number of leaf springs 28 and/or their separate rigidities. For instance, for a relatively heavy wheelchair user, generally, a greater torsion rigidity will be set, by filling the torsion bar 22 with more and/or more rigid leaf springs. The torsion rigidity, together with, inter alia, the weight of the user have an influence on the frequency and stroke with which the sitting support 8 will oscillate during use.

Further, a bias of the torsion spring 22 can be set by turning the covers 27 relative to each other and/or the frame parts 11. Thus, the leaf springs 28, which are clamped-in by their extremities between the receiving means 33 of the covers 27, are twisted, so that a certain bias is induced in the torsion spring. This bias has, inter alia, an influence on the angle of tilt of the seat 14 in unloaded and statically loaded condition. As the covers 27 can be attached at different angles to the clasps 37, in the manner described hereinabove, different biases can be set per user, a larger set angle corresponding to a larger bias. The setting accuracy which can be obtained is dependent on the number and the relative position of the holes 34, 88. According as the number of holes 34, 38 is larger, the step between successive angles to be set will be smaller and a finer setting of the bias will become possible. Further, a finer setting possibility can be obtained by placing the holes 38, situated pair-wise opposite each other in the clasp 37, at an angle deviant from 90 degrees relative to each other and each time to attach the clasp 37 to the cover 27 with only two oppositely located bolts 39.

The torsion bar 22 shown in FIG. 2 represents only one possible embodiment. Many others are possible. For instance, a torsion bar can be formed by a shaft with a spiral spring, by a claw coupling clad with an elastic material or by a rubber sleeve. These and comparable variations are all understood to fall within the scope of the term "torsion bar".

The tilting movement of the sitting support 3 works as follows. As the coupling means 7 are arranged such that the pivot axis 20, viewed from the driving direction A, lies relatively far forward, in any case in front of the center of gravity of a person seated during use in the wheelchair 1, this person, at least his weight, will apply a moment to the seating support 3 under the influence of which at least the seat 14 tilts backwards. The seat 14 tilts to a position $\phi$ in which a balance is achieved between the moment applied by the user and a supporting moment applied by the coupling means 7. Preferably, the spring rigidity of the coupling means 7, in particular of the torsion bar 22, is selected such that the balance mentioned occurs at a position $\phi$ in which the seat 14 is tilted backwards somewhat. Thus, under the influence of his own weight, the user will be pushed into the sitting support 3, which will give him a feeling of stability. Furthermore, in this position, the center of gravity of the user has a stable position, i.e. at a limited height above the ground and, viewed in top plan view, between the axles 10, 13 of the front and rear wheels 9, 12, respectively.

When the user changes his sitting posture, for instance by leaning backwards, his center of gravity too will move. As a result, the balance of moments is disturbed, and the seat 14 will pivot to a new position in which a balance is achieved between the upwardly directed moment of the supporting coupling means 7 and the downwardly directed moment applied by the weight of the user onto the seat 14. In this manner, the position of the seat 14 constantly adapts itself to the sitting posture of the user and the latter is always optimally supported.

Further, the free pivot provision has a comfort-enhancing effect during active use of the wheelchair in that external shocks and vibrations which, as a result of, for instance, irregularities in the road surface, act on the substructure 5 of the wheelchair are not directly transmitted to the seat 14, but, instead, are transformed into a more comfortable, preferably damped pivotal movement of the seat 14 about the pivot axis 20. The sitting support 3 together with the wheelchair user and the supporting coupling means 7 forms a mass spring system which, under the influence of the external forces mentioned, will oscillate, the frequency of the oscillating movement being substantially dependent on the spring rigidity of the coupling means 7 and the weight of the user, and the amplitude of the oscillations gradually decreasing as a result of the damping present in the coupling means 7.

Due to the favorable position of the pivot axis 20 relative to the center of gravity of the wheelchair user, the wheelchair 1 will also remain in balance during the above-described free pivotal movement during active use of the wheelchair. The fact is that, during pivoting, the center of gravity will move horizontally to only a very limited extent and, therefore, remain within a stable area bounded by the axles 10, 13 of the rear and front wheels 9, 12.

Figure 3:
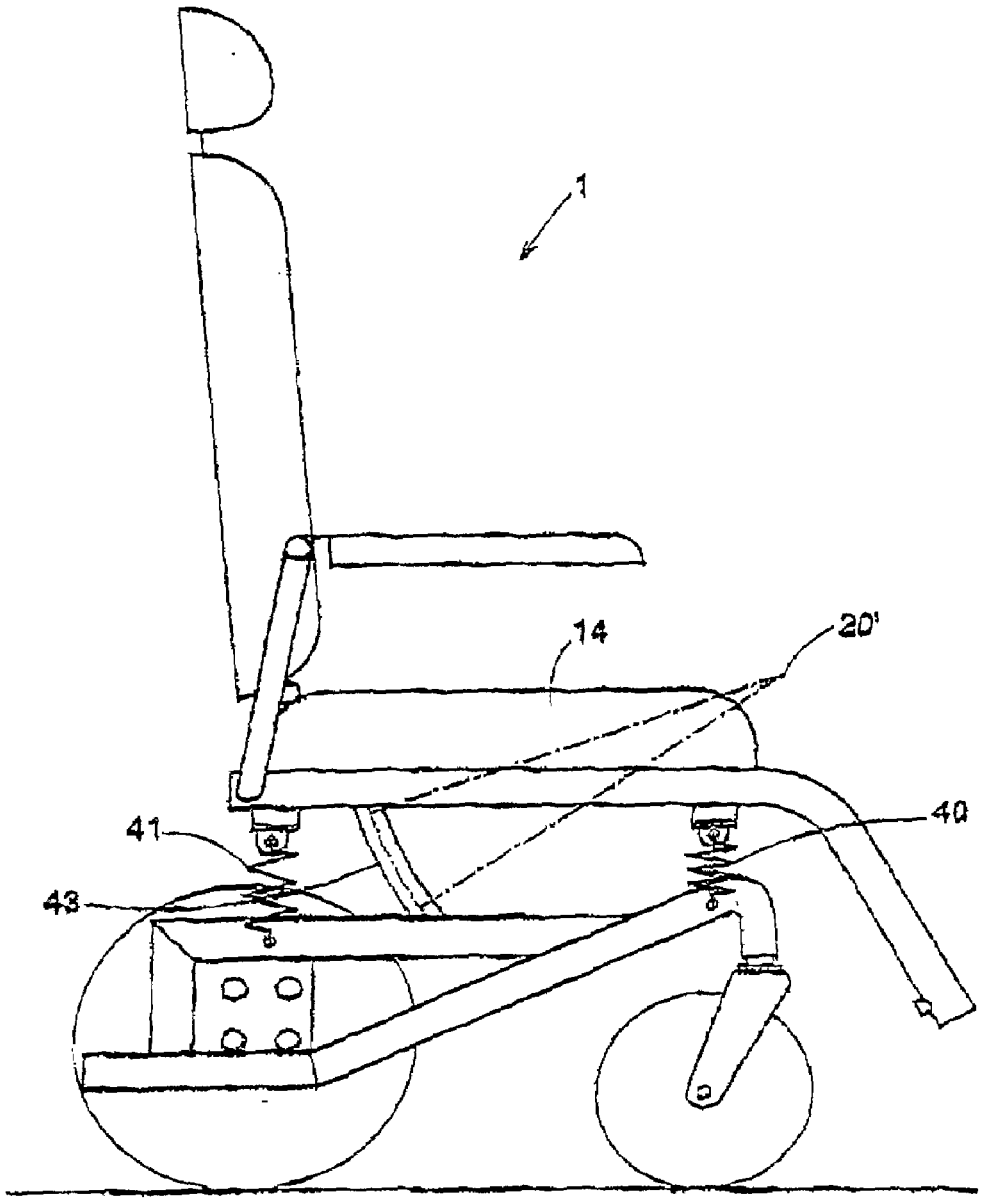
FIG. 3 shows a second embodiment of a wheelchair according to the invention provided with a virtual pivot axis.

The pivot axis 20 can be a physical axis, as is the case in FIG. 1 where the pivot axis 20 coincides with the torsion bar 22. However, the pivot axis 20' can also be virtual. An embodiment thereof is represented in FIG. 3. The wheelchair shown in FIG. 3 is comparable in structure to that of FIG. 2. However, in this case, the coupling means 7 below the sitting support 3, in particular the seat 14, comprise two parallel springs 40, 41. The rigidity of the first spring 40, leading in driving direction, is greater than that of the trailing second spring 41. Thus, a virtual pivot axis 20' is realized which, through a correct selection of the spring rigidities and the relative position of the springs 40, 41, can be placed adjacent the hinge point of the knee joint of a user seated in the seating support, as represented in FIG. 3. Further, preferably, a guiding element 43 is provided below or adjacent the sitting support 3, with which the path and the pivot axis 20' of the pivoting seat 14 can be accurately fixed.

Figure 5A:
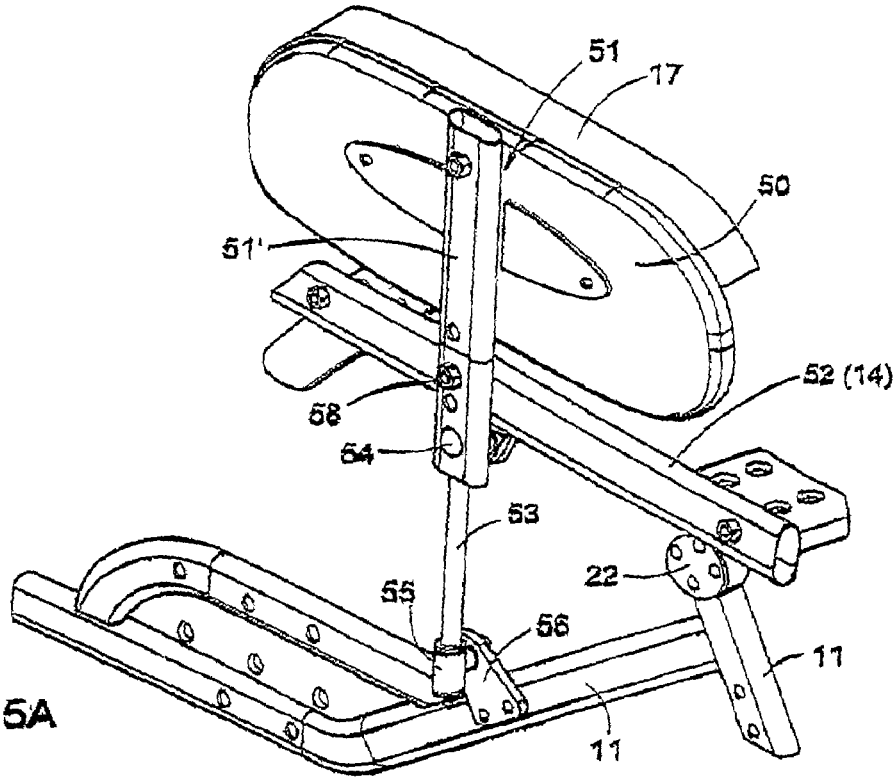
FIG. 5 shows a construction for keeping an armrest horizontal during tilting of the sitting support in perspective view.
Figure 5B:
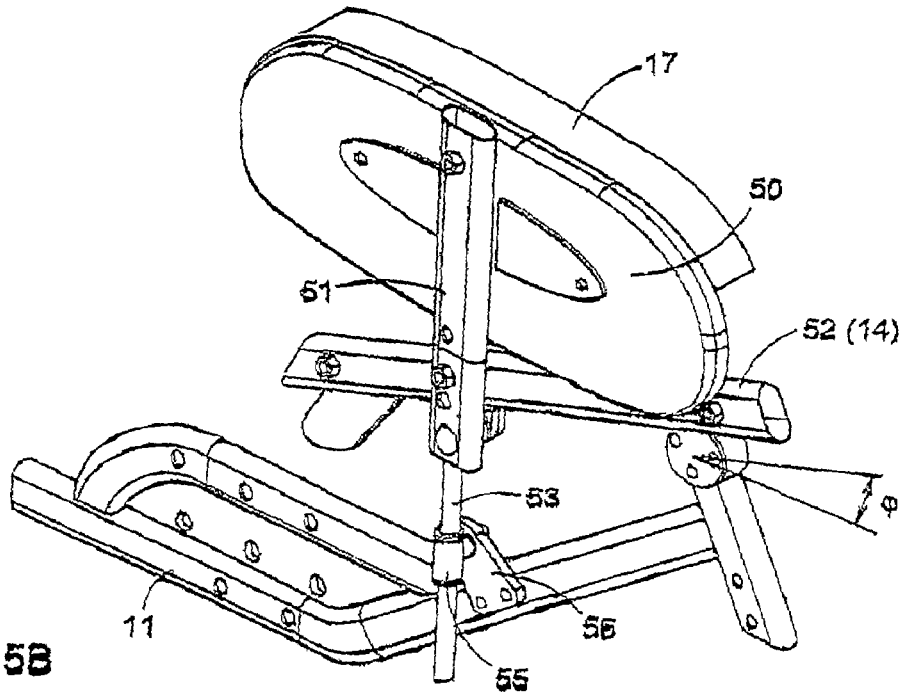

The advantage of a virtual pivot axis 20' is that it, as such, does not take up any physical space and, therefore, through a correct design of the coupling means 7, can be placed anywhere, regardless of the available space. As a result, in the above-mentioned example, the pivot axis 20' of the sitting support 3 can be situated adjacent the hinge point of the knees of a wheelchair user, without hindering this user with the presence of one or more physical axes. A pivot axis 20' coinciding with the hinge point of the knee joint offers the advantage that during the tilting of the sitting support 3, the upper part of the body and the upper legs of the wheelchair user can tilt along without changing the position of the lower legs. As a result, the influence of the lower legs on the position of the center of gravity of the user is eliminated. Furthermore, during tilting, the user can rest his feet on the ground or on the footrests 18 arranged on the substructure 5. This will provide him with a more stable feeling and help him getting up from the wheelchair. Further, with a pivot axis 20' coinciding with the hinge point of the knee, the knees will move minimally during tilting of the sitting support 3, so that the pivot provision can also be used when the wheelchair is partly under a table or at a location otherwise limited in height. In this situation, it can further be advantageous when, during tilting of the sitting support 3, the armrests 17 too maintain a substantially horizontal position. FIGS. 5*a* and 5*b* show an armrest construction with which this is possible. The construction comprises an armrest 17, at least a side plate 50 thereof, and an armrest tube 51 rigidly connected to this side plate 50. Via a hinge 54, armrest plate 50 and tube 51 are pivotally connected to the wheelchair seat 14, in particular a supporting frame part 52 thereof. The seat 14 is pivotable about a pivot axis 20, formed by, for instance, the above-described torsion bar 22. Further, the armrest construction comprises a guiding bar 53 which is connected through a first end to the armrest tube 51, and, with a second end, is slideably received in a guiding sleeve 55. This guiding sleeve 55 is pivotably connected to a fastening plate 56, which, in its turn, is connected to a frame part 11 of the wheelchair substructure 5. When the seat 14 pivots backwards or is pivoted backwards, as shown in FIG. 5*b*, the guiding bar 53 will forcibly move downward through the guiding sleeve 55. As a result, the armrest 17, which is connected via the armrest plate 50 and the armrest tube 51 to the guiding bar 53, will remain approximately horizontal.

In the armrest construction shown, the guiding bar 58, the guiding sleeve 55 and the fastening plate 56 are detachably connected to the frame 11 and the armrest tube 51. Thus, if desired, the construction can simply be converted to a construction where the armrests can indeed pivot along with the seat 14. To that end, only the guiding bar 53 and, optionally, the guiding sleeve 55 and the fastening plate 56 need to be removed and the hinge 54 blocked. In this manner, the armrest tube 51 and arm plate 50 are rigidly connected to the seat 14 and will pivot along as a whole with this seat 14. Further, with the armrest construction shown in FIG. 5, the armrest tube 51 is built up from two parts, which are detachably connected to each other via a bolt 58. As a result, the upper tube part 51' with the side plate 50 and the armrest 17 can simply be removed, which, for instance, may be desired for helping a wheelchair user into or out of his wheelchair.

In the Japanese patent application 3-100920 of applicant (equivalent to U.S. Pat. No. 5,181,762, issued Jan. 26, 1993 to Anton H. Beumer), an alternative armrest construction is described with which the armrests 17 can be held horizontally during backward tilting of a sitting support 3 or a part thereof. This U.S. Pat. No. 5,181,762 is understood to be incorporated herein by reference.

Figure 4:
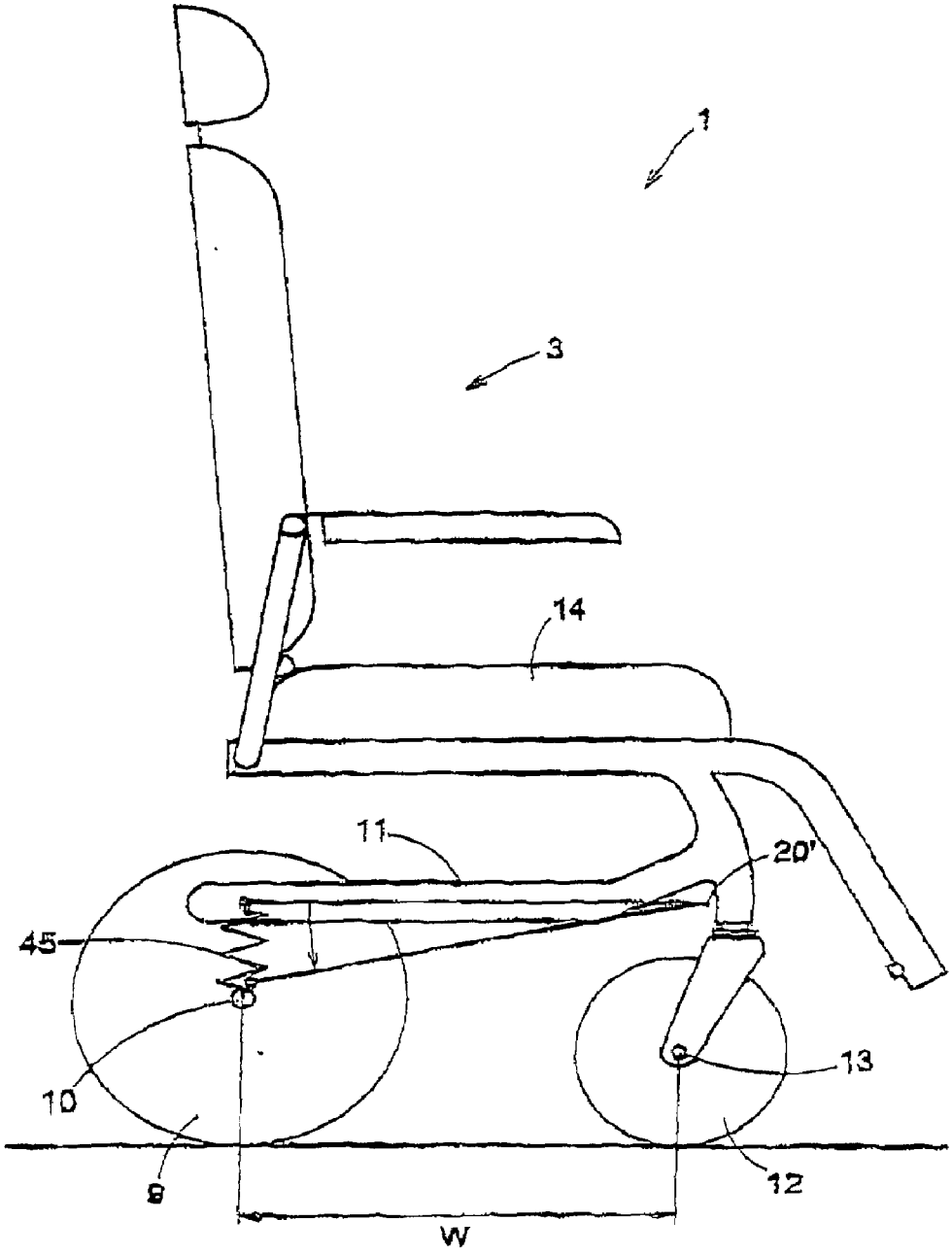
FIG. 4 shows a third embodiment of a wheelchair according to the invention provided with a virtual pivot axis.

FIG. 4 shows a further embodiment of a wheelchair 1 wherein the sitting support 3, in particular the seat 14, is pivotable about a virtual pivot axis 20'. As to construction, the wheelchair 1 is, again, comparable to the wheelchair of FIG. 1. In this embodiment, the coupling means 7 comprise at least two springs 45 and preferably one or more damping elements (not shown), provided between the frame 11 of the substructure 5 and the rear wheels 9. The seat 14 and the front wheels 12 are connected to the frame 11, rigidly or, optionally, movably with the aid of, for instance, a four-bar mechanism (not shown) providing for a vertical, at least preselected position of the front wheel supporting frame parts, regardless of the pivotal movement of the seat 14. When a wheelchair user seats himself in the sitting support 3, the moment applied by him will cause the seat 14 and the frame 11 to pivot backwards about a virtual axis 20'. The springs 45 are thereby compressed and, with the rigid connection mentioned, the front wheels 12 move somewhat forwards and/or the rear wheels 9 somewhat backwards. With this embodiment, a backward pivotal movement is therefore accompanied by an increase of the wheel base W, the distance between the axles 10, 13 of the front and rear wheels 9, 12, so that the wheelchair 1 obtains an even more stable road-holding. The position of the virtual axis 20' is influenced, inter alia, by the position of the spring 45, in particular its point of engagement on the frame 11.

The bias and rigidity of the or each resilient element of the coupling means 7 are preferably adjustable, either once-only at purchase of the wheelchair, or repeatedly during use. With the bias, the pivot angle $\phi$ of the seat 14, where the moments applied to the seat 14 by the coupling means 7 and the user are in balance, can be influenced. For example, the bias can be set to be thus that the seat 14, in unloaded condition, inclines forward somewhat towards an active sitting angle $\phi_2$ of, for instance, 10°-20°. Such an active step-in and step-out angle facilitates sitting down in and getting up from the sitting support 3, in that the user has to bend his knees less. Also, the intended position of balance $\phi$ only occurring with a relatively far backwardly tilted seat 14 can be prevented.

With the rigidity of the resilient element of the coupling means 7, the free pivotal movement during active use of the wheelchair can be influenced, particularly its frequency and stroke, so that these can be optimally adjusted to, inter alia, the anticipated driving conditions and the individual characteristics and desires of a user.

To optimize the damping of the pivotal movement during active wheelchair use, additional damping means can be provided. For instance, between a frame part 11 of the substructure 5 and the sitting support 3 an elastic element filled or not filled with air or liquid can be placed, for instance manufactured from rubber or another damping material known from practice.

Further, the coupling means 7 comprise a blocking provision, with which the sitting support 3 can be locked steplessly in any desired tilting position, for instance in a backwardly pivoted, passive or resting position $\phi_1$. With the coupling means 7 shown in FIG. 1, this is achieved in that the length 30 of the gas spring 25 can be blocked. In the embodiment shown in FIG. 3, for instance, the guiding element 43 can be provided with a blocking element which is slideable along this guiding element and which can be secured at any position of the guiding element, thus checking a further pivotal movement of the sitting support 3. Further, the coupling means 7, in particular the torsion bar 22 can be provided with an adjusting provision, with which the position of the pivot axis 20 can be adjusted. However, such an adjustment provision can also be arranged in the substructure 5, for instance by means of a telescopically extendable frame part 23, as shown in FIG. 1 or by rebushing the front wheels 12 or by providing several holes one above the other in the fork 24 in which the caster wheels 12 have been suspended. A difference between the two alternatives is that an adjustment of the position of the pivot axis 20 by means of an adjustment provision within the torsion bar 22 will have no influence on the wheel base W, while, generally, an adjustment provision in the substructure 5 will have an influence.

The footrests 18 can be attached to the pivotable part of the sitting support 3, so that, upon a pivotal movement thereof, they pivot along and the angle between lower and upper legs remains constant. However, it can also be favorable to attach the footrests to the substructure 5, so that, upon tilting of the sitting support 3, the lower legs remain at a fixed position, with the associated advantages mentioned hereinabove.

All combinations of parts of the embodiments shown are understood to be incorporated herein.

Figure 6:
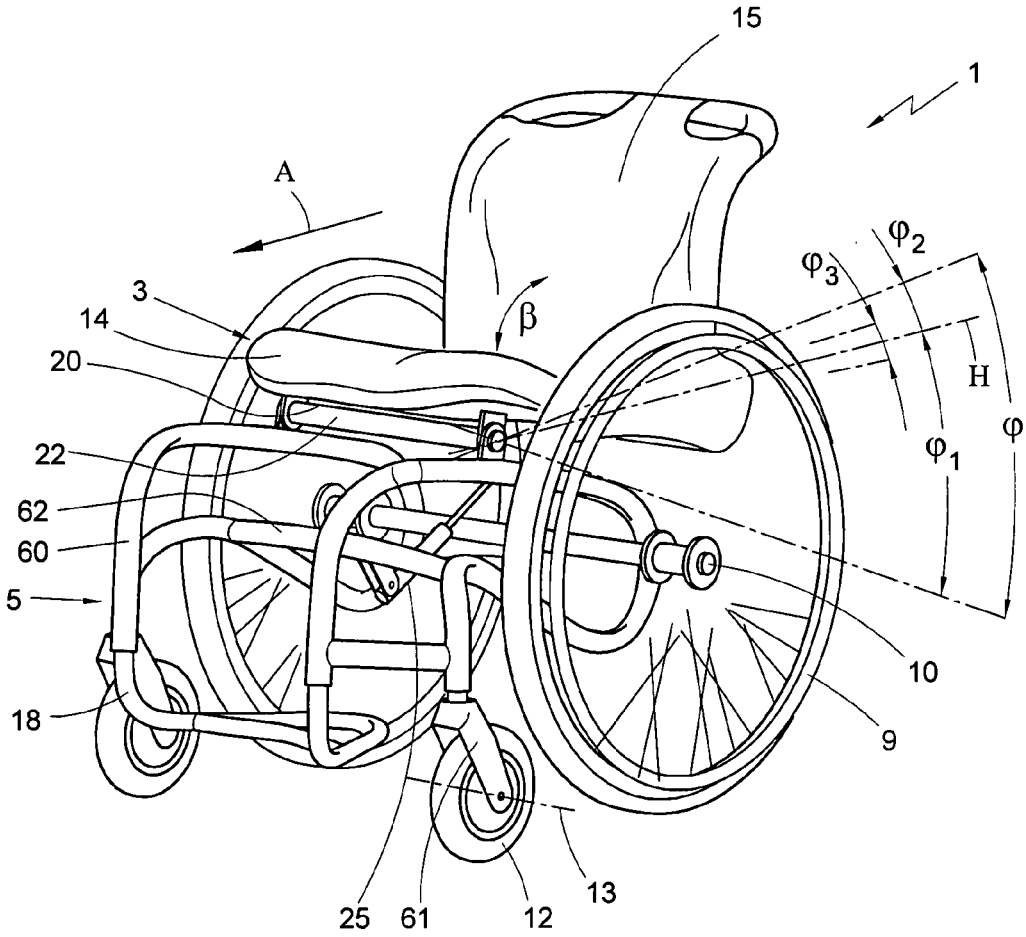
FIG. 6 shows a further alternative embodiment of a wheelchair according to the invention.

FIG. 6 shows a perspective view of a further alternative embodiment of a wheelchair 1 according to the invention, shown here with relatively large rear wheels 9, for instance of 20 or 21 inch, and relatively small, pivotable front wheels 12, for instance of 8 or 10 inch. Again, identical parts have identical reference numerals. In this embodiment, the substructure 5 is substantially built up from two double bent tubes 60, for instance from aluminum, forming two frame halves and between which a torsion bar 22 as described earlier is received. With the aid of forks 61, the front wheels 12 are mounted in the tubes 60. The footrest 18 too is formed from tube, inserted in open ends of the tubes 60. Further, adjacent the front of the wheelchair 1, between the tubes 60, a cross tube 62 is provided for increasing the rigidity. Thus, a relatively light, rigid frame is obtained with a pleasant appearance. The seat 14 with the back rest 15 connected thereto is connected to the torsion bar 22, at least the pivot axis thus formed, such that the seat 14 with the back rest 15 can pivot from the horizontal H, on the one hand to a backwardly tilted, passive pivot angle to be called $\phi_1$ and, on the other hand to a forward, active angle, to be called $\phi_2$. The angle $\phi_2$, is for instance, 5 to 15°, preferably approximately 10°, the passive angle $\phi_1$ for instance between 10 and 30°, preferably about 20°. Between the cross bar 62 and the seat 14, a gas spring 25 is mounted, which is preferably fastened adjacent the back of the seat 14. Thus, movements of the seat 14 can be damped. Furthermore, the gas spring 25 can simply be designed such that, therewith, the seat can be secured in a selected pivot angle $\phi$, preferably both in an active sitting angle $\phi_2$ and in a passive sitting angle $\phi_1$. Then, it is preferred that the gas spring 25 is fastened such that the seat 14 can pivot around the set angle $\phi_1$ through a relatively small angle $\phi_3$ for obtaining increased comfort as a result of some spring action. The angle $\phi_3$ can be, for instance, a few degrees.

A wheelchair 1 according to the invention, in particular a wheelchair such as for instance shown in FIG. 6, is particularly suitable as workplace wheelchair. The fact is that the seat 14 can be pivoted to an active sitting angle $\phi_2$ and be secured, a user being seated relatively high, for instance at a height equal to an ordinary office chair, while, upon a backward pivoting movement to a passive angle $\phi_1$, the center of the seat M, and, thus, the sitting height is reduced over a distance D and the user can simply rest. In an intermediate position a user can simply secure the seat in a selected pivot angle and move the wheelchair. The wheelchair can be used well, both inside and outside.

It is preferred that the back rest 15, relative to the seat 14, can be adjusted through the angle $\beta$, between an angle of approximately 180°, where the back rest 15 extends approximately in alignment with the seat 14 and a user can lie virtually flat, and to an angle $\beta$ of, for instance, approximately 0°, where the back rest 15 is pivoted onto the seat 14, as storage position. Then, the seat is preferably brought into the passive position, somewhat between the tubes 60, so that a particularly compact construction is obtained. With such a position, it is preferred that anti-tilting means are provided, for instance a supporting element such as a leg or a further wheel, placeable or foldable on the rear side.

As a result of, in particular, the position of the pivot axis 20 and the fastening points of the gas spring 25, the seat can be pivoted over the desired, relatively large angle, so that a particularly large adjustment range is obtained. The space below the seat between the frame halves, for instance between the tubes 60, remains free for pivoting the seat.

The invention is not in any way limited to the exemplary embodiments of the description and represented in the drawings. Many variations thereon are possible within the framework of the invention as outlined by the claims.

For instance, the coupling means can be designed in many manners. For instance, instead of a gas spring, a hydraulic cylinder can be used. For instance, instead of parallel springs, a layer of resilient material can be provided under the seat, the spring rigidity of this layer increasing gradually in the driving direction. Also, coupling means without resilient elements can be realized, for instance with the aid of one or more rod mechanisms. Further, to increase the damping, for instance plastic leaf springs can be built in, or, for instance, damping elements filled with air or liquid, such as air bellows springs. Further, it may be advantageous in certain situations to, conversely, incorporate no or minimal damping, so that a freely swinging sitting support is obtained, which reacts to minimal movements of a seated person. In practice, it has been found that such a swinging sitting support may have a therapeutic effect for patients with much motional restlessness.

Further, an operating mechanism may be provided with which an attendant can simply activate the coupling means, so that the sitting support can be tilted into a desired position and, optionally, be secured in this position. Such an operating mechanism can for instance be integrated in the pushing brackets with which the attendant pushes the wheelchair forward.

These and many variants are understood to fall within the framework of the invention as outlined by the claims.

The invention claimed is:

1. A wheelchair, comprising:

a substructure; and a sitting support;

wherein the substructure is provided with at least two wheels and the sitting support comprises at least one seat, wherein the sitting support is attached via coupling means to the substructure such that, during use, at least the seat is pivotable about a pivot axis extending substantially horizontally, substantially at right angles to a main driving direction of the wheelchair, which pivot axis, viewed in the main driving direction, lies far forward, in particular in front of the center of the seat;

wherein the coupling means comprise a blocking provision with which at least the seat can be fixed in a desired pivoted position ($\phi$); and wherein the blocking provision is arranged such that the seat can pivot in a resilient manner about the fixed desired pivoted position ($\phi$) through an angle ($\phi_3$);

wherein the pivot axis is formed by a torsion bar;

wherein the sitting support, in particular the seat, is supported at a distance from the pivot axis, by at least one damping element; and wherein the at least one damping element is an elastic element filled with air or liquid, which is pivotably connected to the substructure and the seat of the sitting support, and whose length can be blocked.

2. A wheelchair, comprising:

a substructure; and a sitting support;

wherein the substructure is provided with at least two wheels and the sitting support comprises at least one seat, wherein the sitting support is attached via coupling means to the substructure such that, during use, at least the seat is pivotable about a pivot axis extending substantially horizontally, substantially at right angles to a main driving direction of the wheelchair, which pivot axis, viewed in the main driving direction, lies far forward, in particular in front of the center of the seat;

wherein the pivot axis is formed by an adjustable torsion bar, wherein the torsion bar comprises a tube, which is provided on opposite sides with a cover, wherein within the tube at least one leaf spring is received, the ends of which are locked in a receiving provision provided on each cover and wherein a bias of the torsion bar is settable by turning one or each cover.

3. A wheelchair, comprising:

a substructure; and a sitting support;

wherein the substructure is provided with at least two wheels and the sitting support comprises at least one seat, wherein the sitting support is attached via coupling means to the substructure such that, during use, at least the seat is pivotable about a pivot axis extending substantially horizontally, substantially at right angles to a main driving direction of the wheelchair, which pivot axis, viewed in the main driving direction, lies forward, in particular in front of the center of the seat;

wherein the coupling means between the substructure and the sitting support at least comprise one resilient element; and wherein the bias of the at least one resilient element is settable such, that at least the at least one seat of the sitting support in unloaded condition is tilted forward and in a condition loaded by a user is substantially horizontal or is tilted backwards , wherein the pivot axis is formed by an adjustable torsion bar comprising a tube, which is provided on opposite sides with a cover, wherein within the tube at least one leaf spring is received, the ends of which are locked in a receiving provision provided on each cover and wherein a bias of the torsion bar is settable by turning one or each cover.

4. A wheelchair according to claim 3, wherein the coupling means comprise at least one damping element.

5. A wheelchair according to claim 4, wherein the coupling means comprise a blocking provision with which at least the seat can be fixed in a desired pivoted position ($\phi$).

6. A wheelchair according to claim 5, wherein the blocking provision is arranged such that the seat can pivot in a resilient manner about the fixed desired pivoted position ($\phi$) through an angle ($\phi_3$).

7. A wheelchair, comprising:

a substructure; and a sitting support;

wherein the substructure is provided with at least two wheels and the sitting support comprises at least one seat, wherein the sitting support is attached via coupling means to the substructure such that, during use, at least the seat is pivotable about a pivot axis extending substantially horizontally, substantially at right angles to a main driving direction of the wheelchair, which pivot axis, viewed in the main driving direction, lies far forward, in particular in front of the center of the seat;

wherein the coupling means comprise a blocking provision with which at least the seat can be fixed in a desired pivoted position ($\phi$); and wherein the blocking provision is arranged such that the seat can pivot in a resilient manner about the fixed desired pivoted position ($\phi$) through an angle ($\phi_3$), wherein the pivot axis is formed by an adjustable torsion bar comprising a tube, which is provided on opposite sides with a cover, wherein within the tube at least one leaf spring is received, the ends of which are locked in a receiving provision provided on each cover and wherein a bias of the torsion bar is settable by turning one or each cover.

8. A wheelchair according to claim 7, wherein the pivot axis is located adjacent a plane extending vertically, at right angles to the main driving direction through an axis of the each front wheel.

9. A wheelchair according to claim 8, wherein said pivot axis is located in front of said plane.

10. A wheelchair according to claim 7, wherein the pivot axis lies, at least higher than a horizontal plane through a each highest positioned wheel axle.

11. A wheelchair according to claim 7, wherein when a user is seated in the wheelchair, the pivot axis is located adjacent a hinge point of each knee of the user, and wherein an upper body part of the user, including at least the user's center of gravity, viewed in the main driving direction, lies behind the pivot axis.

12. A wheelchair according to claim 7, wherein the coupling means are located below the seat, while forming a real or, virtual pivot axis.

13. A wheelchair according to claim 7, wherein the coupling means between the substructure and the sitting support at least comprise one resilient element.

14. A wheelchair according to claim 7, wherein the bias of the at least one resilient element is settable such that at least the seat of the sitting support in unloaded condition is tilted forward, and in a condition loaded by a user is horizontal or is tilted backwards.

15. A wheelchair according to claim 1, wherein a bias of the torsion bar is settable.

16. A wheelchair according to claim 1, wherein the sitting support, in particular the seat, is supported at a distance from the pivot axis, by at least one damping element.

17. A wheelchair according to claim 7, wherein the sitting support comprises a leg rest, pivoting along with the seat, and a back rest, head rest and armrests.

18. A wheelchair according to claim 7, wherein the substructure is provided with a leg support.

19. A wheelchair according to claim 7, wherein the sitting support comprises a frame of double bent tubes, over which frame an elastic upholstery is stretched.

20. A wheelchair according to claim 7, wherein at least the seat is pivotable about an angle of at least 20° and is securable in pivoted positions.

21. A wheelchair according to claim 20, wherein the seat is at least pivotable between an active sitting angle ($\phi_2$) of +10° to a passive sitting angle ($\phi_1$) of approximately −20° relative to the horizontal (H).

22. A wheelchair according to claim 7, wherein at least two wheels are provided with a diameter of at least 20 inch.

23. A wheelchair according to claim 7, wherein by pivoting the seat about the pivot axis, the center of the seat can be moved at least 10 cm in vertical direction.

24. A wheelchair according to claim 7, wherein at least the seat is pivotable about an angle of at least 30° and is securable in pivoted positions.

* * * * *

UNITED STATES PATENT AND TRADEMARK OFFICE

CERTIFICATE OF CORRECTION

PATENT NO. : 7,243,935 B2
APPLICATION NO. : 10/171800
DATED : July 17, 2007
INVENTOR(S) : Stefanus Theodorus A.G. Beumer It is certified that error appears in the above-identified patent and that said Letters Patent is hereby corrected as shown below:

Title page, Under item (74) on the front page of the patent please delete "Michael & Associates" and insert --Michaelson & Associates-- in its place.

Signed and Sealed this

Eighteenth Day of September, 2007

JON W. DUDAS
*Director of the United States Patent and Trademark Office*